United States Patent [19]

Shotwell

[11] Patent Number: 4,887,675

[45] Date of Patent: Dec. 19, 1989

[54] EARTH BORING BIT WITH PIN MOUNTED COMPENSATOR

[75] Inventor: Duane E. Shotwell, Houston, Tex.

[73] Assignee: Hughes Tool Company, Houston, Tex.

[21] Appl. No.: 231,632

[22] Filed: Aug. 8, 1988

Related U.S. Application Data

[63] Continuation of Ser. No. 1,313, Jan. 8, 1987, abandoned.

[51] Int. Cl.[4] ..... E21B 10/22

[52] U.S. Cl. ..... 175/228; 175/337; 384/93

[58] Field of Search ..... 175/227, 228, 337, 367, 175/368; 384/93

[56] References Cited

U.S. PATENT DOCUMENTS

| | | | |
|---|---|---|---|
| 1,896,231 | 2/1933 | Fletcher | 175/228 |
| 3,047,344 | 7/1962 | Gros | 384/93 |
| 3,244,459 | 4/1966 | Ortloff | 384/93 |
| 3,847,234 | 11/1974 | Schumacher, Jr. et al. | 384/93 X |
| 3,998,500 | 12/1976 | Dixon | 175/337 X |
| 4,055,225 | 10/1977 | Millsapps | 175/228 |
| 4,407,375 | 10/1983 | Nakamura | 384/93 X |
| 4,412,590 | 11/1983 | Daly | 175/229 |
| 4,597,455 | 7/1986 | Walters | 175/228 |
| 4,600,064 | 7/1986 | Scales | 175/368 |

*Primary Examiner*—William P. Neuder

*Attorney, Agent, or Firm*—Robert A. Felsman

[57] ABSTRACT

An earth boring (rock) bit having a flexible diaphragm located inside the bearing shaft in a cavity between a threaded lug and a mating bearing sleeve. The diaphragm has an enlarged periphery, shaped somewhat like an o-ring, that is confined and sealed between opposed annular surfaces on the lug and the sleeve. The circular periphery of the diaphragm and cavity provide good compensation volume, from which excessive lubricant pressure is relieved by an enlarged portion which is punctured and contoured to discharge lubricant under excessive pressure while excluding drilling fluid. Simplicity and reliability are achieved by the elimination of multiple and complex manufacture and assembly operations.

3 Claims, 2 Drawing Sheets

EARTH BORING BIT WITH PIN MOUNTED COMPENSATOR

This application is a continuation of application Ser. No. 001,313 filed 01/08/87 now abandoned.

BACKGROUND OF THE INVENTION 1. Field of the Invention

This invention relates generally to earth boring, especially to improvements to bits having lubrications systems that use pressure compensators to minimize the differential pressure across the seals between the rotatable cutters and their supporting, cantilevered bearing pins or shafts.

2. Description of the Prior Art

The commercially viable earth boring or rock bit has a lubrication system that includes a pressure compensator to balance the pressure of the drilling fluid with that of the lubricant inside bit. Advantageously, this minimizes the pressure differential across the bearing seal that separates the drilling fluid from the lubricant in each leg of the conventional three cone rock bit.

Each of the three legs that form the body of the current, commercially successful rock bit contains a complex network of holes and passages to support the compensator and lubrication system. The resulting complexity of manufacture and assembly adversely affects the reliability and performance of an unacceptable number of rock bits. Previously, rock bit patents include those that have compensator systems in each bearing shaft or pin. None have withstood the test of time—at least not in the commercial sense. Thus, the quest for improvement continues.

SUMMARY OF THE INVENTION

Manufacturing simplicity and performance reliability are achieved with a lubrication and pressure compensation system contained in each bearing shaft of a rock bit—using a threaded lug and bearing sleeve to confine a flexible, pressure compensating diaphragm. The diaphragm divides a cavity between the bearing lug and sleeve used to form the bearing pin into a drilling fluid region and a lubricant region. A pressure relief means is included in the diaphragm to relieve excessive pressure build-up in the lubricant. The diaphragm is preferably circular, centrally disposed relative to the bearing pin, and has an enlarged, perforated central portion or hub which serves as the pressure relief means. The central portion or hub is accessible during assembly through a drilled hole (plugged after assembly) by a hollow needle, which penetrates the perforation. Evacuation of air and subsequent lubrication of the system to a selected pressure are thus conveniently achieved.

Additional objects, features and advantages of the invention will be seen in the following description.

DESCRIPTION OF THE PREFERRED EMBODIMENT

Figure 1:
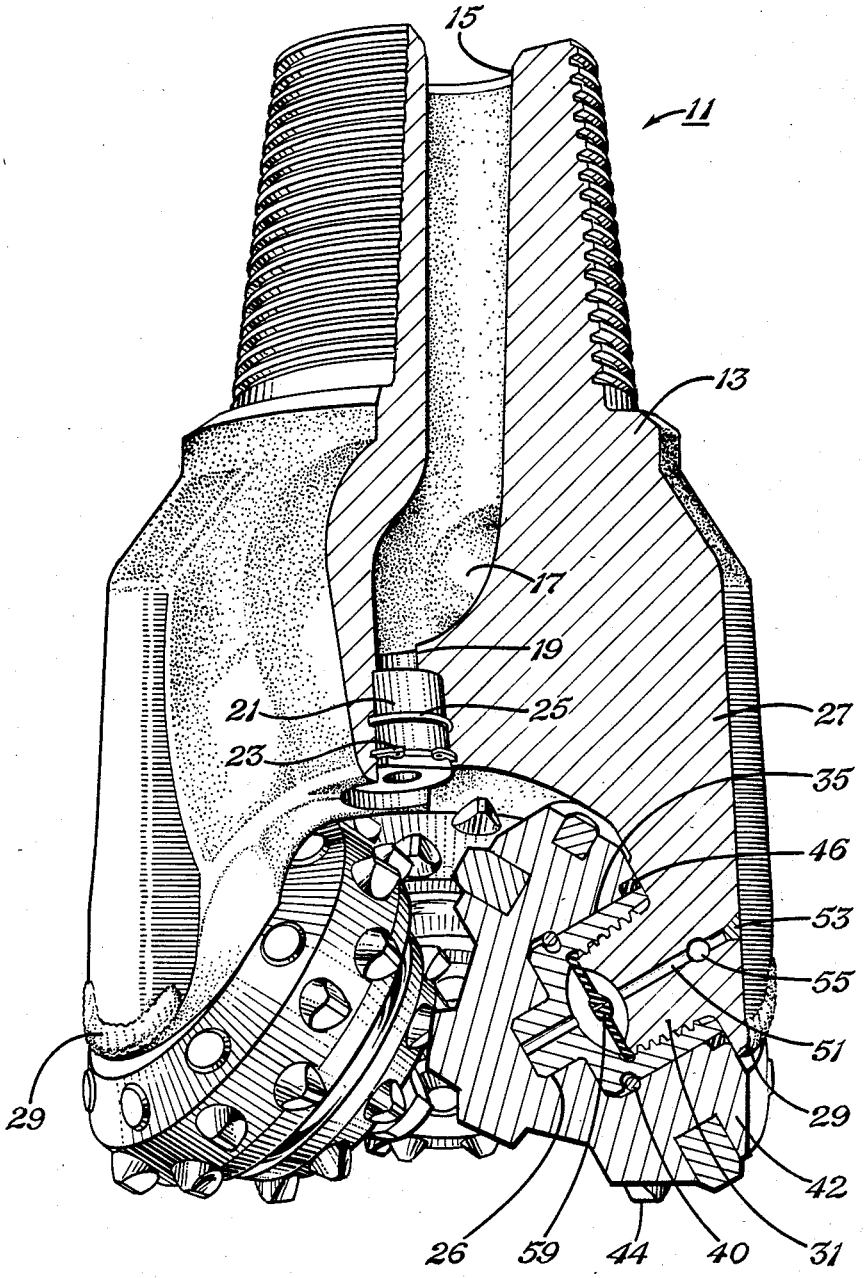
FIG. 1 is a perspective view of a rock bit, partially in longitudinal section, to reveal a pressure compensator system constructed according to the principles of the invention.

The numeral 11 in the drawing designates an earth boring or rock bit having a body composed of three head sections 13. The interior of the bit has a concavity 15 leading to passages 17 and ultimately to drilled recesses 19 that contain nozzles 21, each retained by a snap ring 23 and sealed with an o-ring 25. The lower exterior of each leg 27 typically has a shirttail, with hardfacing at 29 to retard abrasive wear.

Figure 2:
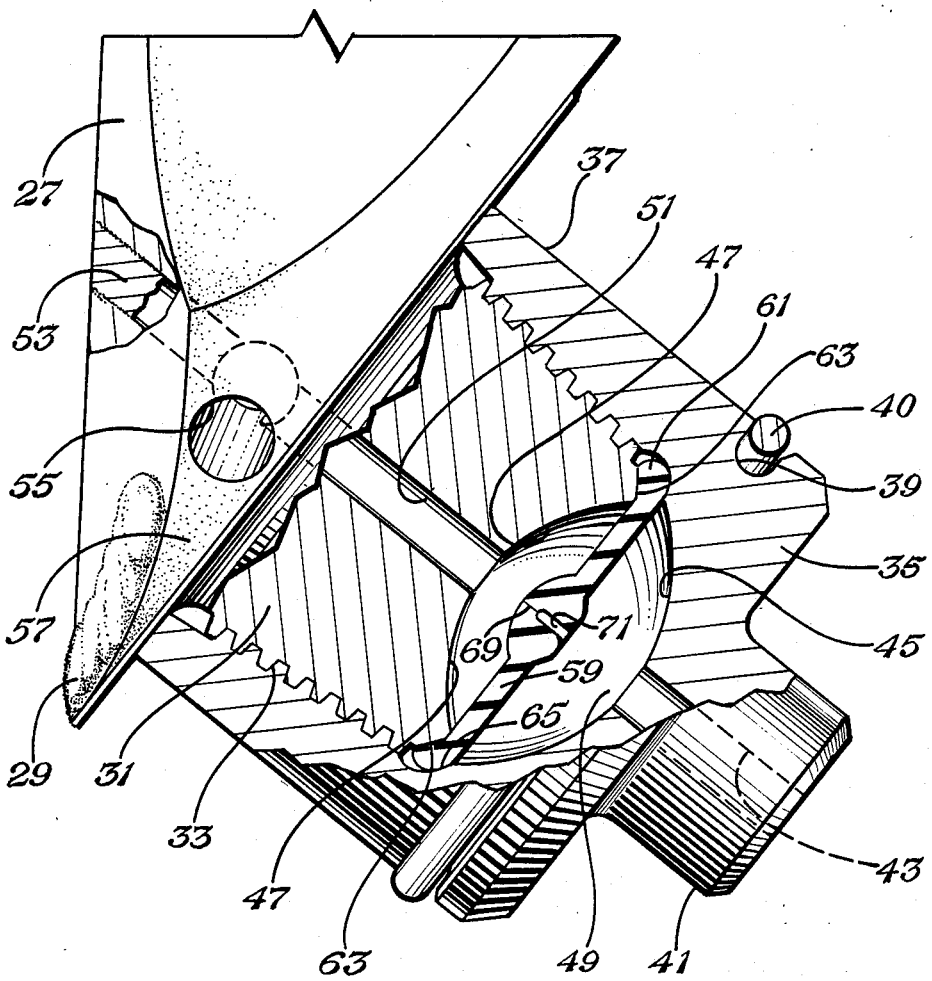
FIG. 2 is a fragmentary view, partially in longitudinal section, illustrating the lubrication and pressure compensating system of FIG. 1 in enlarged detail.
Figure 3:
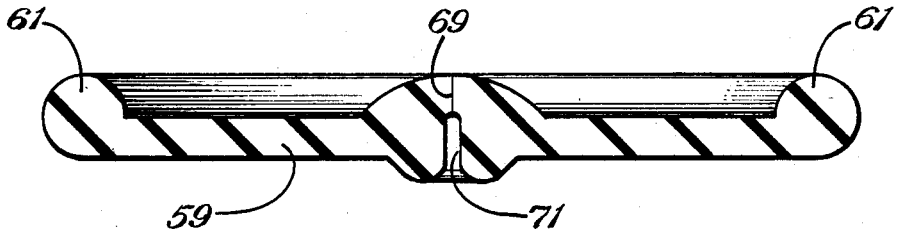
FIG. 3 is an enlarged view, in longitudinal section, of the flexible diaphragm used to separated drilling fluid from lubricant and to achieve pressure compensation.

As best seen in FIG. 2, each leg has a cantilevered bearing lug 31, threaded at 33 with a tapered thread. The lug 31 is oriented to extend downwardly and inwardly and receives a bearing a threaded sleeve 35, with a cylindrical journal bearing 37 and assembly groove 39. As shown in FIG. 1, a resilient snap ring 40 retains a cutter 42 with teeth 44 on the bearing sleeve 35. On the end of the bearing sleeve 35 is a pilot pin 41 through which extends a lubricant passage 43, which terminates in a cavity wall 45, preferably spherical in contour to maximize lubricant cavity volume without adversely affecting strength. The assembly groove 39 is located in a thick wall portion as explained in greater detail in the U.S. Pat. No. 4,600,064, Earth Boring Bit With Bearing Sleeve, July 15, 1986. The bearing lubricant is sealed between each cutter 42 and bearing sleeve 35 by suitable seal means such as o-ring 46.

Another cavity wall 47, also spherical, is formed on the end of the bearing lug 31, defining with wall 45 a cavity 49. A drilling fluid passage 51 leads from the exterior of the leg 27 to the wall 47 of the cavity 49, being closed by the weld 53 at the exterior of leg 27. Intersecting the drilling fluid passage 51 is a fluid port 55 that exits on the trailing side 57 of the leg 27.

Dividing the cavity 49 into a drilling fluid region and a lubricant region is a flexible diaphragm 59 having an enlarged annular periphery 61 shaped somewhat in the form of an o-ring. A pair of opposed, annular surfaces 63, 65 located respectively on the end of the bearing lug 31 and the interior of the bearing sleeve 35, sealingly confined the enlarged periphery 61 of the flexible diaphragm. In FIG. 2 the diaphragm periphery is circular, having an enlarged central portion or hub 67 that is punctured at 69 with depression 71 on the lubricant side. The puncture 69 is self sealing and is used to insert lubricant by a long needle (not shown) into the cavity 49. The puncture 69 in combination with the depression 71 release lubricant when there is a pressure build-up in the lubricant. The enlarged portion 69 has a rounded outer region 68 with a diameter larger than that of drilling fluid passage 51. This prevents packing of the diaphragm in the passage 51. An inner region 70 extends into the lubricant region of cavity 49.

Lubricant is introduced into the cavity by insertion of a hollow needle through driling fluid passage 51 prior to closing with weld 53. The needle extends through the puncture 69 of the enlarged central portion or hub 67 of the diaphragm 59. A vacuum is initially used to rid the bearing and cavity 49 of air. Then lubricant is forced into the cavity and bearing under pressure. After the needle is extracted, weld 53 is used to close the lubricant passage 51. The enlarged central portion or hub 67 of the diaphragm 59 is therefore designed to allow both vacuum greasing and pressure relief. The relief pressure is controlled by the size of the puncture and the section thickness at the center of the hub 67. The shape of the hub allows for grease to be relieved from the bearing, but does not allow for mud to enter. With the needle in place vacuum greasing may be achieved and an internal bearing pressure maintained by removal of the needle at any pressure below that of the selected relief pressure.

In operation of rock bit 11 is lowered into a borehole on the end of a drill string supported by a rotary drill rig (not shown). The hydrostatic pressure of the drilling fluid in the well bore is sensed through fluid port 55 and drilling fluid passage 51 by the flexible diaphragm 59. Consequently, the pressure of the drilling fluid is exerted through diaphragm by the lubricant in cavity 49—as well as the lubricant in lubricant passage 43 and in the spaces around the pilot pin 41 and the journal bearing 37. Pressure build-up in the lubricant, acting through puncture 69 in the diaphragm 59, is relieved by lubricant expulsion. On the other hand excessive pressure build-up in the drilling fluid in cavity 49, acting on the enlarged central portion 67 of the diaphragm seals the puncture 69 even more effectively.

It should be apparent that the invention has significant advantages. The use of the internal cavity 49 located between the bearing lug 31 and bearing sleeve 35 can in some instances provide a higher percentage compensation volume than in prior art systems. The proximity of the cavity to the bearing eliminates some of the pressure losses in the system. The need for a lube well and connecting passages in the head section is eliminated, making manufacture simpler as less costly. Simplicity of manufacture results in greater reliability and enhanced performance.

While the invention has been shown in only one of its forms, it should be apparent to those skilled in the art that it is not thus limited, but is susceptible to various changes and modifications without departing from the principles thereof.

I claim:

1. In a combination with an earth boring bit of the type utilizing a cantilevered and generally cylindrical bearing sleeve threaded onto a bearing lug and retainer means to retain a sealed earth disintegrating cutter on the sleeve, an improved lubrication system which comprises:

a cavity formed generally coaxially with and between the end of the bearing lug and the bearing sleeve and defining an annular seal groove between the end of the lug and the bearing sleeve;

a flexible diaphragm with an annular periphery forming an annular seal means generally coaxially and sealingly secured in the cavity and having an area generally as large as the end of the bearing lug to divide the cavity into a lubricant region and a drilling fluid region and permit movement of the diaphragm in two directions;

lubricant passage means formed through the end of the bearing sleeve to connect the lubricant region of the cavity to the bearing surface;

drilling fluid passage means formed through the center of the lug to connect the drilling fluid region to the exterior of the bit;

one way pressure relief means in a central portion of the flexible diaphragm to limit pressure build-up in the lubricant region by discharging lubricant into the drilling fluid region of the cavity when the lubricant pressure exceeds the drilling fluid pressure.

2. An earth boring bit having an improved lubrication system which comprises:

a bit body which includes at least one leg and a cantilevered and generally cylindrical bearing lug that extends downwardly and inwardly;

a thread formed on the bearing lug;

a bearing sleeve with a substantially cylindrical bearing surface secured to the bearing lug;

a cavity formed generally coaxially with and between the end of the bearing lug and the bearing sleeve and defining an annular seal groove between the end of the lug and the bearing sleeve;

a rotatable cutter with a cylindrical bearing surface assembled on the bearing sleeve;

an assembly groove formed on the cylindrical surface of the bearing sleeve and in a thick walled end region at a location removed from the thread of the bearing sleeve and threaded portion of the bearing sleeve;

a mating retainer groove formed in a rotatable cutter;

a resilient snap ring positioned in the mating assembly and retainer grooves to retain the cutter on the bearing sleeve;

a substantially circular flexible diaphragm with an annular periphery forming an annular seal means generally coaxially and sealingly secured in the cavity to divide the cavity into a large volume lubricant region and a drilling fluid region to permit movement of the diaphragm in two directions;

the diaphragm having in a central portion a one way pressure relief means to prevent entry of drilling fluid into the lubricant region of the cavity and to allow release of lubricant upon lubricant pressure build-up;

lubricant passage means in the end of the bearing sleeve to connect the lubricant region of the cavity to the bearing surface;

drilling fluid passage means in the bearing lug to connect the drilling fluid region to the exterior of the bit.

3. An earth boring bit having an improved lubrication system which comprises:

a bit body which includes at least one leg and a cantilevered bearing lug that extends downwardly and inwardly;

a thread formed in the bearing lug;

a bearing sleeve with a substantially cylindrical bearing surface secured by a threaded portion to the bearing lug;

the bearing sleeve having a length greater than that of its threaded portion to define a thick walled end region;

a cavity, circular in cross section, formed between the end of the bearing lug and the bearing sleeve and defining an annular seal groove between the end of the lug and the bearing sleeve, concentric with their longitudinal axes;

a rotatable cutter with a cylindrical bearing surface assembled on the bearing sleeve;

an assembly groove formed on the cylindrical surface of the bearing sleeve and in a thick walled end region at a location removed from the thread of the bearing sleeve and threaded portion of the bearing sleeve;

a mating retainer groove formed in the rotatable cutter;

a resilient snap ring positioned in the mating assembly and retainer grooves to retain the cutter on the bearing sleeve;

a flexible and circular diaphragm with an annular periphery forming an annular seal means coaxially and sealingly secured in the cavity between the end of the bearing lug and the bearing sleeve to divide the cavity into a large volume lubricant region and a drilling fluid region to permit movement of the diaphragm in two directions;

the diaphragm having a puncture in an enlarged central portion to define a one way pressure relief means to prevent entry of drilling fluid into the lubricant region of the cavity and to allow release of lubricant upon lubricant pressure build-up;

lubricant passage means formed coaxially through the end of the bearing sleeve to connect the lubricant region of the cavity to the bearing surface;

drilling fluid passage means in a central portion of the bearing lug to connect the drilling fluid region to the exterior of the bit.

* * * * *